US007679012B2

(12) United States Patent
Liu et al.

(10) Patent No.: US 7,679,012 B2
(45) Date of Patent: Mar. 16, 2010

(54) HIGH-VOLTAGE AUTOMATIC CHANGEOVER SWITCH

(75) Inventors: Yaohong Liu, Beijing (CN); Yumei Chen, Beijing (CN); Huaping Tang, Beijing (CN); Jianjun Gao, Beijing (CN); Xinshui Yan, Beijing (CN); Feng Gao, Beijing (CN); Wei Jia, Beijing (CN); Xiaotian Liang, Beijing (CN); Jinsheng Liu, Beijing (CN); De Wei, Beijing (CN); Wei Yin, Beijing (CN); Dan Zhang, Beijing (CN); Chong Gu, Beijing (CN); Qinghui Zhang, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 422 days.

(21) Appl. No.: 11/777,639

(22) Filed: Jul. 13, 2007

(65) Prior Publication Data

US 2008/0078922 A1 Apr. 3, 2008

(30) Foreign Application Priority Data

Jul. 17, 2006 (CN) ..... 2006 1 0098856

(51) Int. Cl.
*H01H 21/18* (2006.01)

(52) U.S. Cl. ..... 200/11 TC; 200/48 R; 200/16 R

(58) Field of Classification Search ..... 200/1 R, 200/1 A, 1 V, 11 R–11 TC, 16 R–16 C, 17 R, 200/570, 48 R, 48 P, 48 A
See application file for complete search history.

(56) References Cited

U.S. PATENT DOCUMENTS 3,198,921 A * 8/1965 Clinton ..... 200/1 B (Continued)

FOREIGN PATENT DOCUMENTS

WO 01/60133 A1 8/2001

OTHER PUBLICATIONS

United Kingdom Search Report issued for UK Patent Appl. No. GB0713400.00, dated Aug. 22, 2007.

*Primary Examiner*—Michael A Friedhofer
(74) *Attorney, Agent, or Firm*—Pillsbury Winthrop Shaw Pittman LLP

(57) ABSTRACT

A high-voltage automatic changeover switch, includes a support and a control circuit board mounted on the support. In one embodiment, the support includes an insulating frame, four high-voltage contacts mounted on each of two opposite plates of the insulating frame, four high-voltage contacts on the same plate being pair-to-pair arranged, the high-voltage contacts at the corresponding positions on the two plates being pair-to-pair arranged. A motor is provided on the support, and when switching the high voltages, the control circuit board controls the rotation of the motor to automatically switch the connection relation between the high-voltage contact pairs. Embodiments of the switch have a voltage-resistance of above 50 KV, allowing a pulse current of not less than 500 A to pass through, and good contact performance and a high stability. In one aspect, the high-voltage automatic changeover switch performs automatic switching of power source high voltages in an accelerator system, so that the accelerator obtains electron beams with different energies, thus allowing an expanded scope of application of the accelerator, including updating and upgrading of non-destructive testing systems, custom container inspection systems, and high-energy CT systems.

10 Claims, 3 Drawing Sheets

U.S. PATENT DOCUMENTS 3,590,175 A * 6/1971 Bleibtreu et al. ..... 200/11 TC
5,224,592 A * 7/1993 Jedlitschka et al. ..... 200/572
5,679,935 A * 10/1997 Baba et al. ..... 200/17 R
5,786,552 A * 7/1998 Dohnal et al. ..... 200/11 TC
6,124,557 A * 9/2000 Kang ..... 200/400
6,693,248 B1 * 2/2004 Schultz ..... 200/11 TC
6,740,831 B2 * 5/2004 Baertl et al. ..... 200/459
6,833,518 B1 * 12/2004 Byers et al. ..... 200/11 TC

* cited by examiner

HIGH-VOLTAGE AUTOMATIC CHANGEOVER SWITCH

BACKGROUND

This disclosure generally relates to a changeover switch and in particular, relates to a high-voltage automatic changeover switch for use in a dual-energy or multi-energy electron accelerator system.

An electron accelerator is a device for accelerating charged particles to have a high energy by an electromagnetic field in vacuum, while an electron linear accelerator is a device for accelerating electrons along a linear track by a microwave electromagnetic field. The electron accelerator is widely used in the fields of industry non-destructive test, custom container inspection, high-energy CT, electron beam radiation and so on. In order to obtain a high-intensity acceleration electric field, the electron linear accelerator for accelerating electrons by the microwave electromagnetic field generates a large instantaneous microwave power and works in a pulse form. A high-voltage pulse modulator is a main composite part of such a microwave source and mainly includes a magnetron or klystron, a high-voltage module, a charging module, a pulse forming network module, and a pulse transformer, etc. The high-voltage pulse generated by the high-voltage pulse modulator is supplied to the magnetron and an electron gun, and the high voltage is usually 48 KV and 20 KV or so.

A dual-energy or multi-energy electron accelerator system is an electron accelerator system capable of outputting electron beam streams with two or more kinds of energies. Compared with the traditional single-energy electron accelerator system, the dual-energy or multi-energy electron accelerator system is different not only in diversity of stand-alone energies but having a greater technical advantage of its combination with a new-generation detector system, data image processing system and so on to distinguish different substance materials. In the traditional fields of industry non-destructive test, custom container inspection, high-energy CT, and so on, the single-energy accelerator system can only be used to identify shapes of the object, whereas the dual-energy or multi-energy accelerator system can be used to identify both shapes and material of the object. Thus, the dual-energy or multi-energy accelerator system has wider prospects for application.

In order to obtain electron beam streams with different energies in an accelerator system, it is necessary to realize it by supplying different operating voltages to the magnetron and electron gun. The selection of different operating voltages to the magnetron and electron gun is realized by a high-voltage automatic changeover switch. This high-voltage automatic changeover switch is required to have a high voltage-resistant performance, not less than 50 KV, to allow a great pulse current to pass through, not lower than 500 A, to have a good contact performance and a high stability, and to be automatically switchable. The high-voltage automatic changeover switch which sufficiently satisfies such application conditions has not been found in the existing high-voltage components and devices.

SUMMARY

In one embodiment, a high-voltage automatic changeover switch having a good voltage-resistant performance is provided in consideration of the above drawbacks of the conventional approaches. The high-voltage automatic changeover switch according to one embodiment comprises a support and a control circuit board mounted on the support, wherein said support comprises an insulating frame, four high-voltage contacts being mounted on each of two opposite plates of the insulating frame, four high-voltage contacts on the same plate being pair-to-pair arranged, the high-voltage contacts at the corresponding positions on the two plates being pair-to-pair arranged; a motor is provided on the support and, when switching the high voltages, the control circuit board control the rotation of the motor to fulfill the automatically switching of the high-voltage contact pair.

In one aspect of one or more embodiments, an output shaft of the motor extends into the insulating frame, a moving rod is provide on a terminal portion of the shaft, both ends of the moving rod are fixed with rotors working in cooperation with the high-voltage contacts, and the moving rods are made of insulating material.

In another aspect of one or more embodiments, a position contact block is fixed on the output shaft of the motor, and two limit switches working in cooperation with the position contact block are provided on the support.

In another aspect of one or more embodiments, a distance between any two adjacent high-voltage contacts is between approximately 5 cm-10 cm.

In another aspect of one or more embodiments, the insulating frame has a U-shaped section.

In another aspect of one or more embodiments, four spring guide posts are mounted on each of two opposite plates of the insulating frame; the spring guide posts on the same plate are pair-to-pair arranged, and the spring guide posts at the corresponding positions on two plates are pair-to-pair arranged; a compression spring is sheathed on each spring guide post, one end of which is fixed onto the plate and the other is fixed to said high-voltage contacts.

In another aspect of one or more embodiments, both sides of a contact surface between said high-voltage contacts and the rotors, is processed to have a circular arc slope, and two terminals of said rotors in contact with the high-voltage contacts are processed into an elliptical shape. The rotors may be cylindrical, with a diameter of above 8 mm, and the rotors and the high-voltage contacts may be made of a material having a good electrically conductive performance and may be coated with silver or gold.

In another aspect of one or more embodiments, two limit switches may be mounted on the support by means of an elongate mounting hole and a bolt.

The high-voltage automatic changeover switch according to various aspects of one or more embodiments of this disclosure has the following advantages and positive effects: rotor and high-voltage contacts working in cooperation with the rotor, and since the distance between any two adjacent high-voltage contacts is 5 cm-10 cm, the switch of this disclosure is capable of realizing voltage-resistance of 50 KV, and thus has a good voltage-resistant performance; and further, owing to having the motor, position contact block and two limit switches, the switch of this disclosure is capable of realizing automatic switching.

The high-voltage automatic changeover switch according to one or more embodiments of this disclosure switches the high voltages of power sources automatically so that the accelerator can obtain the electron beam streams with different energies, and this may be important for upgrading industry non-destructive test, custom container inspection and high-energy CT.

Figure 1:
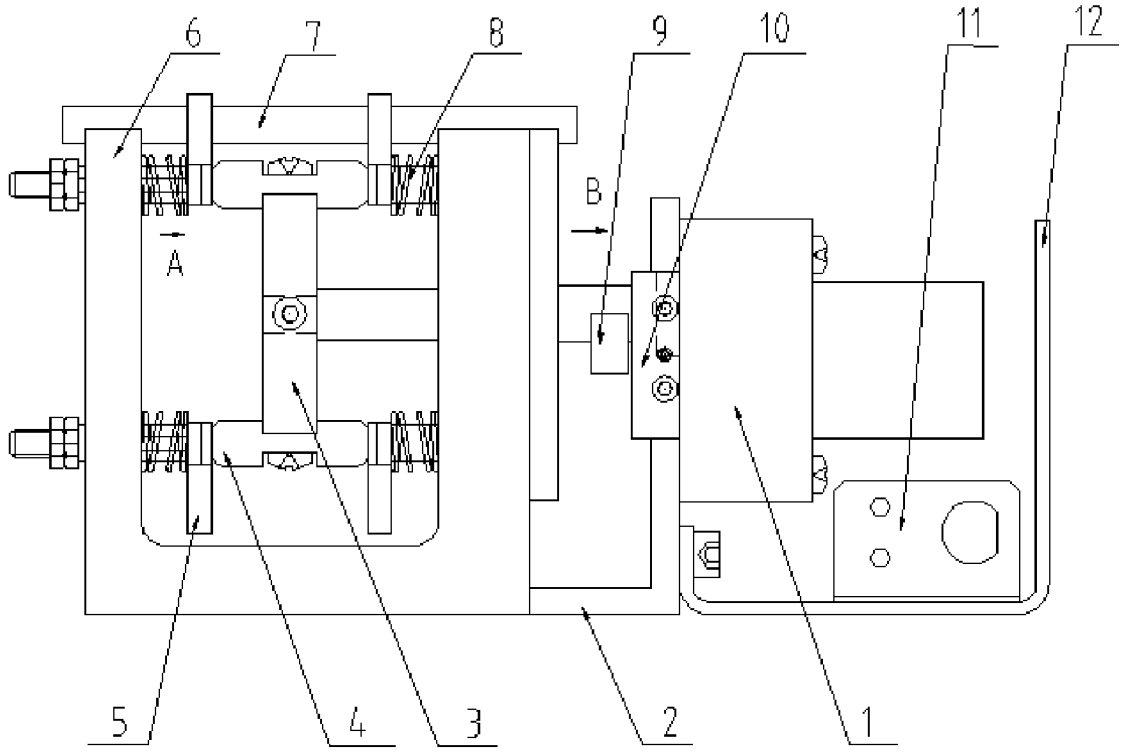
FIG. 1 is a structural view of the high-voltage automatic changeover switch according to the present invention.

The following are the annotations for the reference numerals in the above Figures: 1—motor; 2—mounting rack; 3—moving rod; 4—rotors; 5—high-voltage contacts; 6—insulating frame; 7—pull rod; 8—compression spring; 9—position contact block; 10—limit switches; 11—control circuit board; 12—fixed frame; 13—fuse; 14—relay.

DETAILED DESCRIPTION

The further detailed description of an embodiment of the high-voltage automatic changeover switch according to this disclosure is provided below, without the purpose of limiting the scope of the claimed invention.

Figure 2:
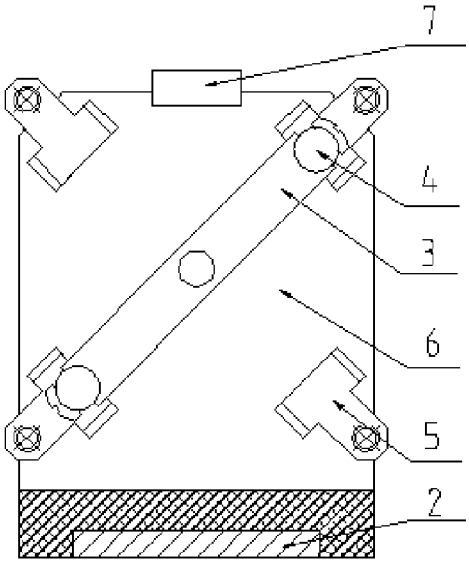
FIG. 2 is a A-directional view in FIG. 1.
Figure 3:
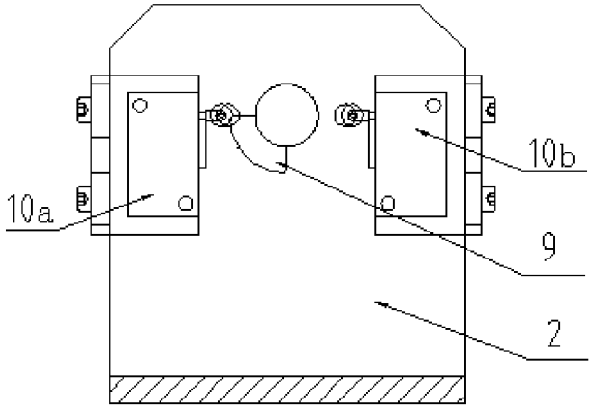
FIG. 3 is a B-directional view in FIG. 1.

Referring to FIGS. 1, 2 and 3, the high-voltage automatic changeover switch according to an embodiment comprises an insulating frame 6 with a U-shaped section, an L-shaped mounting rack 2 in fixed connection with the insulating frame 6, and a J-shaped fixed frame 12 in fixed connection with the mounting rack 2. To assure the stability of the U-shaped structure, a pull rod 7 made of an insulating material is mounted at an opening of the U-shaped insulating frame 6.

Four spring guide posts are fixed on each of two opposite plates of the U-shaped insulating frame 6, four spring guide posts on the same plate being pair-to-pair arranged, the spring guide posts at the corresponding positions of two plates being pair-to-pair arranged. A compression spring 8 is sheathed on each spring guide post, one terminal of which is fixed to the plate and the other is fixed with a high-voltage contact 5. A mounting distance between two adjacent high-voltage contacts 5 on the same plate is 6 cm, and the mounting distance between any two high-voltage contacts 5 on two plates is not smaller than 5 cm. The foregoing mounting distance is usually in the range of 5 cm-10 cm or can be much bigger with the permission of the structure and volume, so that the voltage-resistance between the contacts is not less than 50 KV.

The mounting rack 2 is provided with a motor 1 thereon and an output shaft of the motor 1 is connected with a horizontal rod which extends into the U-shaped insulating frame 6 and a terminal portion of which is fixed with a moving rod 3 perpendicular thereto. Both ends of the moving rod 3 are fixed with a rotor 4 respectively, and said rotors 4 work in cooperation with the high-voltage contacts 5. Both sides of a contact surface between the high-voltage contact 5 and the rotor 4 are processed to have a circular arc slope and both ends of the rotor 4 are processed to an elliptic shape, thereby facilitating keeping good contact between the rotor 4 and the high-voltage contact 5. The rotor 4 and the high-voltage contact 5 are made of a material having a good electrically conductive performance and are coated with silver or gold to improve the electrically conductive performance. The rotors 4 are cylindrical, with a diameter of 10 mm. Usually, the diameter of the rotors 4 is greater than 8 mm so as to assure the pulse current allowed to pass through to be not less than 500 A. A compression spring 8 makes the contact between the high-voltage contact 5 and the rotor 4 more reliable. A position contact block 9 is mounted fixedly on the output shaft of the motor 1, and limit switches 10*a*, 10*b* are respectively provided on the mounting rack 2 and at both sides of the output shaft of the motor. The two limit switches 10*a*, 10*b* are mounted on the support by means of an elongate mounting hole and a bolt, and their positions are adjustable. The position contact block 9 works in cooperation with the two limit switches 10. During working, the motor 1 drives the moving rod 3 and two rotors 4 on the moving rod 3 to rotate, thereby causing the rotors 4 to connect or disconnect the high-voltage contacts 5 in pair.

Figure 4:
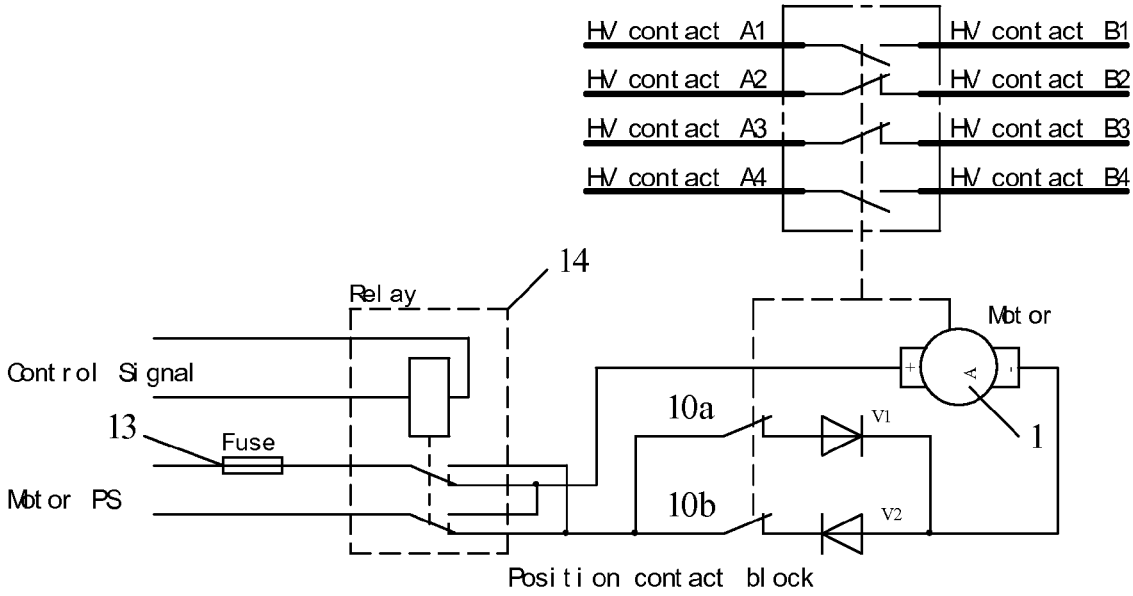
FIG. 4 is a structural view of the control circuit board in the high-voltage automatic changeover switch according to the present invention.

Refer to FIG. 1 and FIG. 4. The control circuit board 11 in the present invention is fixed to the J-shaped fixed frame 12 and includes a fuse 13, a relay 14, a diode and other electronic components. The act of the motor 1 is controlled by the control circuit board 11 so as to realize the high-voltage automatic changeover function. During rotation of the motor 1, the position contact block 9 contacts or disconnects the limit switches 10, and the limit switches issue an ON/OFF signal to the control circuit board 11; the control circuit board 11 enables the motor to stop rotation so that the rotor 4 stops at an appropriate position, thereby causing two pairs of high-voltage contacts 5 to be stably connected.

When a control signal is input to the control circuit board 11, the relay coil is attracted and the motor obtains a forward power supply and rotates forwardly to drive the rotor to cause the high-voltage contacts A1 and B1, A4 and B4 to be connected; meanwhile, the position contact block 9 on the moving rod contacts the limit switch 10*a*, and the limit switch 10*a* is disconnected and the motor stops rotation, the high-voltage contacts A1 and B1, A4 and B4 keeping connected. When the control signal is disconnected, the relay coil is released and the motor obtains a backward power supply and rotates backwardly to drive the rotor to cause the high-voltage contacts A2 and B2, A3 and B3 to be connected; meanwhile, the position contact block 9 on the moving rod leaves the limit switch 10*a* and contacts the limit switch 10*b*, and the limit switch 10*a* is closed and the limit switch 10*b* is disconnected, and the motor stops rotation, the high-voltage contacts A2 and B2, A3 and B3 keeping connected. Consequently, the control signal is connected or disconnected to realize connection or disconnection between different sets of high-voltage contacts, thereby realizing the automatic changeover function.

The high-voltage automatic changeover switch according to the present invention has a voltage-resistance of above 50 KV, allows a pulse current of not less than 500 A to pass through, has a good contact performance and a high stability, and is capable of realizing automatic switching. The high-voltage automatic changeover switch according to the present invention performs automatic switching of high voltages of the power sources in an accelerator system, so that the accelerator obtains electron beams with different energies. This plays an important role in expanding the applicable scope of the accelerator, updating and upgrading of an industry non-destructive testing system, custom container inspection system and high-energy CT system. The high-voltage automatic changeover switch according to the present invention is further applicable to the similar industry system in which high-voltage switching is required.

Although the particular description has been made for the present invention, those skilled in the art can modify the particular structure or conceive other equivalent structures. Accordingly, the present invention is not limited by the particular structure in the above embodiment, and the high-voltage automatic changeover switch according to the present invention can have other structures as long as the control circuit can control the rotation of the motor mounted on the support to fulfill the automatically switching of the high-voltage contact pair.

The above provides various aspects of embodiment of the invention. According to the contents disclosed by this disclosure, some similar and alternate solutions which can be obviously envisaged by those skilled in the art should fall within the scope of the claimed invention.

What is claimed is:

1. A high-voltage automatic changeover switch, comprising:

a support and a control circuit board mounted on the support, wherein said support comprises:

an insulating frame, four high-voltage contacts mounted on each of two opposite plates of the insulating frame, four high-voltage contacts on a same plate being pair-to-pair arranged, the high-voltage contacts at the corresponding positions on the two plates being pair-to-pair arranged;

a motor arranged on the support, and wherein, when switching the high voltages, the control circuit board controls a rotation of the motor to automatically switch a connection relation between the high-voltage contact pairs.

2. The high-voltage automatic changeover switch of claim 1, wherein an output shaft of the motor extends into the insulating frame, a moving rod is provided on a terminal portion of the shaft, both ends of the moving rod are fixed with rotors working in cooperation with the high-voltage contacts, and the moving rod comprises an insulating material.

3. The high-voltage automatic changeover switch of claim 2, wherein a position contact block is fixed on the output shaft of the motor, and two limit switches working in cooperation with the position contact block are operatively arranged on the support.

4. The high-voltage automatic changeover switch of claim 3, wherein said two limit switches are mounted on the support by an elongate mounting hole and a bolt.

5. The high-voltage automatic changeover switch of claim 2, wherein both sides of a contact surface between said high-voltage contacts and the rotors comprise a circular arc slope, and two ends of said rotors in contact with the high-voltage contacts comprise an elliptical shape.

6. The high-voltage automatic changeover switch of claim 5, wherein said rotors are cylindrical, with a diameter of greater than 8 mm.

7. The high-voltage automatic changeover switch of claim 6, wherein said rotors and the high-voltage contacts comprise an electrically conductive material coated with either silver or gold.

8. The high-voltage automatic changeover switch of claim 1, wherein a distance between any two adjacent high-voltage contacts is in the range of 5 cm-10 cm.

9. The high-voltage automatic changeover switch of claim 1, wherein the insulating frame comprises a U-shaped section.

10. The high-voltage automatic changeover switch of claim 1, wherein four spring guide posts are mounted on each of two opposite plates of the insulating frame, the spring guide posts on a same plate being pair-to-pair arranged, the spring guide posts at corresponding positions on two plates being pair-to-pair arranged, each spring guide post being sheathed by a compression spring, one end of which is fixed onto the plate and the other end being fixed to said high-voltage contacts.

* * * * *